US009877567B2

(12) United States Patent
Simard

(10) Patent No.: US 9,877,567 B2
(45) Date of Patent: Jan. 30, 2018

(54) ERGONOMIC COSMETIC APPLICATOR

(71) Applicant: Avon Products, Inc., Suffern, NY (US)

(72) Inventor: Marisol Simard, Upper Nyack, NY (US)

(73) Assignee: AVON PRODUCTS, INC., Suffern, NY (US)

( * ) Notice: Subject to any disclaimer, the term of this patent is extended or adjusted under 35 U.S.C. 154(b) by 526 days.

(21) Appl. No.: 13/658,397

(22) Filed: Oct. 23, 2012

(65) Prior Publication Data

US 2014/0109927 A1 Apr. 24, 2014

(51) Int. Cl.

| | |
|---|---|
| ***A45D 40/26*** | (2006.01) |
| ***A45D 34/04*** | (2006.01) |
| ***A46B 5/00*** | (2006.01) |
| ***A46B 9/02*** | (2006.01) |
| *A46B 11/00* | (2006.01) |

(52) U.S. Cl.

CPC ..... *A45D 40/265* (2013.01); *A45D 34/045* (2013.01); *A45D 34/046* (2013.01); *A45D 40/267* (2013.01); *A46B 5/0075* (2013.01); *A46B 9/021* (2013.01); *A46B 9/026* (2013.01); *A46B 11/0093* (2013.01); *A46B 2200/1053* (2013.01)

(58) Field of Classification Search

USPC ..... 132/216–218, 317, 320; 401/121, 122, 401/126, 129, 130; 15/207.2, 160, 206

See application file for complete search history.

(56) References Cited

U.S. PATENT DOCUMENTS

| | | | | |
|---|---|---|---|---|
| 2,007,245 A | | 7/1935 | Gimonet | |
| 2,569,246 A | | 9/1951 | Marcellus | |
| 3,516,423 A | | 6/1970 | Seidler | |
| 3,866,257 A | | 2/1975 | Cansdale, Sr. | |
| 3,998,235 A | | 12/1976 | Kingsford | |
| 4,165,755 A | * | 8/1979 | Cassai | 132/218 |
| 4,222,677 A | | 9/1980 | Cervantes | |
| 4,404,977 A | | 9/1983 | Vasas | |

(Continued)

FOREIGN PATENT DOCUMENTS

| | | | | |
|---|---|---|---|---|
| DE | 202010012918 | * | 4/2012 | A45D 34/00 |
| EP | 0761122 A1 | | 3/1997 | |

(Continued)

OTHER PUBLICATIONS

U.S. Appl. No. 29/435,337, filed Oct. 23, 2012, Simard, Marisol.

(Continued)

*Primary Examiner* — Tatiana Nobrega

(74) *Attorney, Agent, or Firm* — Brian P. McCloskey; Elizabeth Morters

(57) ABSTRACT

An ergonomic applicator is provided for applying a cosmetic composition to the eyelashes. The applicator comprises a handle portion and a head portion wherein the longitudinal axis of the head portion is positioned or can be rotatably positioned with respect to the longitudinal axis of the handle. The handle being suitable dimensioned for holding between the thumb and fingers without rotation of the handle. The head portion having at its distal end means for holding a charge of cosmetic composition and transferring it to the eyelashes on contact therewith, such as but not limited to bristles.

10 Claims, 7 Drawing Sheets

(56) References Cited

U.S. PATENT DOCUMENTS

| | | | | | |
|---|---|---|---|---|---|
| 4,517,701 | A | | 5/1985 | Stanford, Jr. | |
| 5,086,793 | A | | 2/1992 | Kingsford | |
| 5,188,131 | A | | 2/1993 | Toll | |
| 5,307,826 | A | | 5/1994 | Iosilevich | |
| 5,309,929 | A | | 5/1994 | Toll | |
| 5,328,282 | A | * | 7/1994 | Charrier et al. | 401/4 |
| 5,743,279 | A | | 4/1998 | Gueret | |
| 5,765,573 | A | * | 6/1998 | Gueret | 132/218 |
| 5,855,214 | A | * | 1/1999 | Heneghan | 132/320 |
| 5,881,743 | A | | 3/1999 | Nadel | |
| 6,012,465 | A | | 1/2000 | Gueret | |
| 6,026,824 | A | * | 2/2000 | Gueret | 132/218 |
| 6,050,273 | A | * | 4/2000 | Lhuisset | 132/317 |
| 6,082,999 | A | | 4/2000 | Tcherny | |
| 6,062,757 | A | * | 5/2000 | Gueret | 401/122 |
| 6,073,634 | A | * | 6/2000 | Gueret | 132/218 |
| 6,076,531 | A | * | 6/2000 | Gueret | 132/218 |
| 6,200,051 | B1 | * | 3/2001 | Gueret | 401/122 |
| 6,220,254 | B1 | * | 4/2001 | Gueret | 132/313 |
| 6,280,113 | B1 | * | 8/2001 | Gueret | 401/122 |
| 6,328,495 | B1 | * | 12/2001 | Gueret | 401/122 |
| 6,345,405 | B1 | | 2/2002 | Brackin | |
| 6,581,610 | B1 | * | 6/2003 | Gueret | 132/218 |
| 7,219,801 | B2 | | 5/2007 | Christian | |
| 7,226,555 | B2 | | 6/2007 | Weihrauch | |
| 7,429,141 | B2 | * | 9/2008 | Habatjou | 401/127 |
| 7,487,784 | B2 | | 2/2009 | Gueret | |
| D589,210 | S | | 3/2009 | Wonderley et al. | |
| D629,650 | S | | 12/2010 | Funka, Jr. et al. | |
| 8,434,187 | B2 | | 5/2013 | Weinberger et al. | |
| 2002/0020425 | A1 | | 2/2002 | Dorsa et al. | |
| 2002/0023657 | A1 | | 2/2002 | Gueret | |
| 2004/0134007 | A1 | | 7/2004 | Davies | |
| 2005/0115011 | A1 | | 6/2005 | Petit | |
| 2005/0217691 | A1 | | 10/2005 | Petit | |
| 2005/0236008 | A9 | | 10/2005 | Gueret | |
| 2006/0182486 | A1 | | 8/2006 | Habatjou | |
| 2008/0023020 | A1 | | 1/2008 | Gueret | |
| 2008/0107470 | A1 | * | 5/2008 | Gueret | 401/129 |
| 2008/0178901 | A1 | | 7/2008 | Montoli | |
| 2008/0271746 | A1 | | 11/2008 | Gueret | |
| 2008/0317542 | A1 | * | 12/2008 | Gueret | 401/121 |
| 2009/0162129 | A1 | | 6/2009 | Ferrari | |
| 2009/0183339 | A1 | | 7/2009 | Duan et al. | |
| 2009/0217531 | A1 | | 9/2009 | Muraguchi | |
| 2009/0314305 | A1 | | 12/2009 | Bachrach et al. | |
| 2010/0218781 | A1 | * | 9/2010 | McNamara et al. | 132/200 |
| 2011/0174328 | A1 | * | 7/2011 | Cerutti et al. | 132/200 |
| 2012/0045268 | A1 | * | 2/2012 | Geuther et al. | 401/121 |
| 2012/0103361 | A1 | * | 5/2012 | Geuther | 132/218 |
| 2012/0148332 | A1 | * | 6/2012 | Stredak et al. | 401/122 |
| 2013/0036565 | A1 | | 2/2013 | Gueret | |

FOREIGN PATENT DOCUMENTS

| | | | | |
|---|---|---|---|---|
| EP | 0861616 | A1 | 9/1998 | |
| EP | 0978241 | A1 | 2/2000 | |
| IL | 53249 | A | 11/1984 | |
| JP | D1429889 | | 12/2011 | |
| TW | 265211 | | 12/1995 | |
| TW | D144097 | S1 | 12/2001 | |
| TW | D116807 | S | 5/2007 | |
| TW | D117040 | | 5/2007 | |
| TW | D137008 | S1 | 9/2010 | |
| TW | D146938 | S | 5/2012 | |
| WO | WO 2010042878 | A1 * | 4/2010 | A46B 5/00 |
| WO | 2012066102 | A1 | 5/2012 | |

OTHER PUBLICATIONS

U.S. Appl. No. 13/062,592, filed Mar. 7, 2011, Cerutti et al.
U.S. Appl. No. 13/744,684, filed Jan. 18, 2013, Simard, Marisol.
U.S. Appl. No. 29/435,340, filed Oct. 23, 2012, Simard, Marisol.
U.S. Appl. No. 29/435,337, filed Oct. 23, 2012, Simard, Marisol, U.S. Pat. No. D. 720,542, Jan. 6, 2015.
U.S. Appl. No. 29/435,327, filed Oct. 23, 2012, Simard, Marisol.
U.S. Appl. No. 29/435,330, filed Oct. 23, 2012, Simard, Marisol, U.S. Pat. No. D. 704,450, May 13, 2014.
U.S. Appl. No. 29/435,342, filed Oct. 23, 2012, Simard, Marisol.
U.S. Appl. No. 29/435,540, filed Oct. 25, 2012, Simard, Marisol, U.S. Pat. No. D. 694,019, Nov. 26, 2013.
U.S. Appl. No. 29/435,348, filed Oct. 23, 2012, Simard, Marisol.
U.S. Appl. No. 29/435,353, filed Oct. 23, 2012, Simard, Marisol, U.S. Pat. No. D. 708,064, Jul. 1, 2014.
U.S. Appl. No. 29/435,321, filed Oct. 23, 2012, Simard, Marisol, U.S. Pat. No. D. 700,439, Mar. 4, 2014.

* cited by examiner

FIG. 2
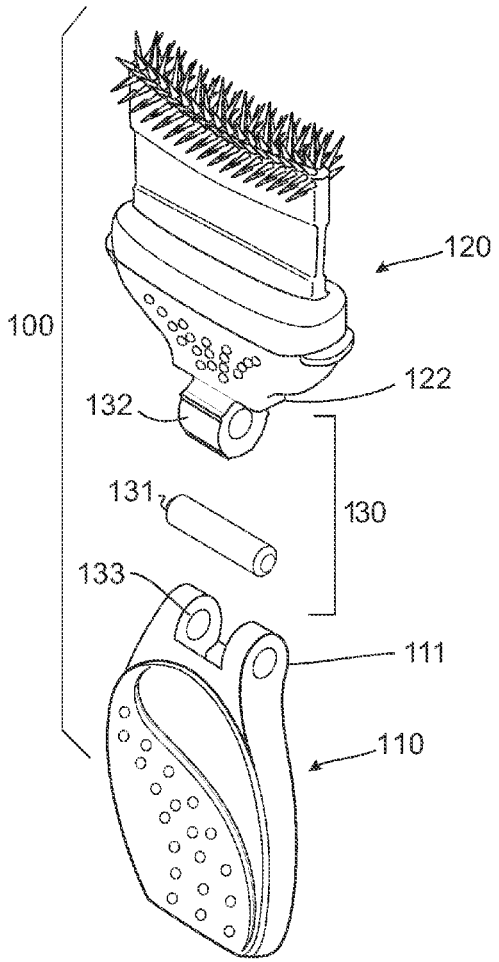
FIG. 3A
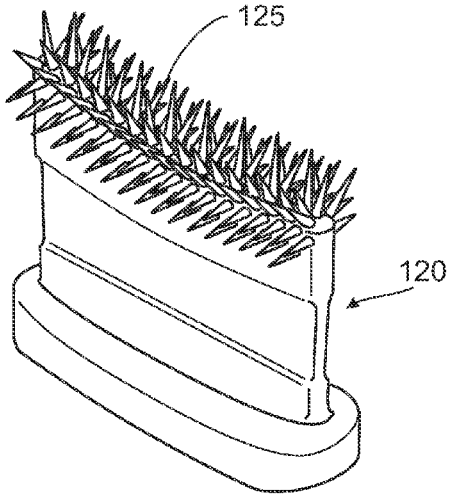
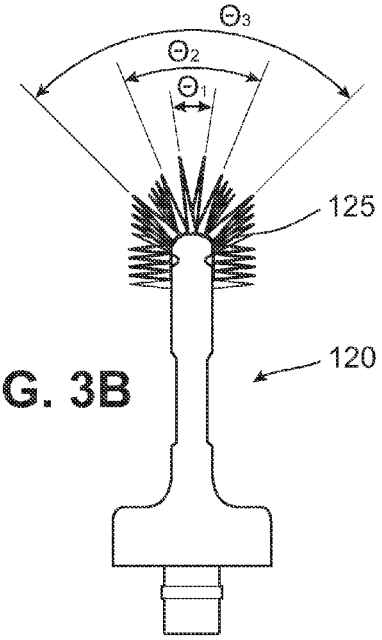
FIG. 3B

ERGONOMIC COSMETIC APPLICATOR

FIELD OF INVENTION

The present invention relates generally to ergonomic applicators and kits including such applicators for applying cosmetic products, such as mascara to eyelashes. The kits may include a flexible reservoir having a chamber disposed therein and a wiper disposed within or above the chamber such that an applicator may be seated within the reservoir and may serve as a closure to prevent the leakage or spillage of a cosmetic product contained therein.

BACKGROUND OF THE INVENTION

The general purpose of a mascara applicator or brush is to pick up a supply of mascara from a container, carry it from a reservoir of the container through a dosing or metering system (in one embodiment, a wiper) without dripping, and apply it evenly to the eyelashes. The applicator must accomplish this without leaving lumps or blobs of the material on the eyelashes.

Conventional mascara applicators generally include a brush attached to an elongated rod that is also connected to a handle. The brush typically comprises a twisted wire core and a bristle portion including a number of uniformly sized bristles spaced evenly throughout its length. The brush and rod are usually housed in a somewhat cylindrical container, and the brush handle forms a closure for the container when the mascara applicator is not in use.

When use of the mascara applicator is desired, the handle is pulled away from the container to remove the mascara-laden brush. During application of mascara to the eyelashes, the brush rod is generally positioned parallel to the face, and oriented horizontally with the brush handle held beside a cheek or temple for purposes of manipulation and alignment of the brush with the eyelashes.

During transfer of mascara to the eyelashes, the applicator is twisted or rotated along its central axis and moved in a vertical, up-and-down motion, while held in a horizontal or vertical position, such as up to the forehead to do the top eyelashes, and down from the forehead to do the bottom eyelashes. Some users will hold the mascara brush handle in the right hand to apply mascara to the right eyelashes, and switch the brush handle to the left hand to apply mascara to the left eyelashes. Other users favor the right or left hand and use the favored hand to apply mascara to the eyelashes of both the right and left eyes. However, even when the favored hand is used for the eyelashes of both eyes, it may be necessary to hold the mascara applicator in the opposite hand to get to the extreme ends of the eyelash that are furthest from the favored hand or closest to the nose bridge.

It should be noted that the application of mascara with conventional mascara applicators usually requires dozens of repeated strokes and rotations or twists to achieve the desired eyelash appearance. Because of the manner in which a conventional mascara applicator is held and manipulated, the application of mascara can be a difficult and tiresome exercise.

SUMMARY OF THE INVENTION

In accordance with the foregoing objectives and others, the present invention provides an ergonomic applicator for applying a cosmetic composition such as mascara to an integument, methods of using the ergonomic applicator, and kits including the ergonomic applicator. In one embodiment, the invention provides a cosmetics applicator that can be easily manipulated with a favored or non-favored hand for applying a cosmetic product. In another embodiment, a cosmetics applicator can be conveniently held with the hand positioned directly in front of the face (although not in the line of sight) rather than off to one side of the head. In another embodiment, a cosmetics applicator can be easily manipulated in the same hand to apply a cosmetic (e.g., mascara) to the full range of eyelashes for both eyes.

In one aspect of the invention, an applicator is provided. The applicator may include a handle portion having a front side opposed from a back side, and the handle portion may be suitably dimensioned to permit the applicator to be held by a user between the thumb and fingers. Generally, the handle may be suitably shaped to prevent rotation and/or otherwise stabilize the handle during use.

The applicator may also include a head portion having at its distal end a plurality of bristles for holding a charge of cosmetic composition and transferring the composition to an integument (for example, an eyelid) and/or to keratin fibers (e.g., hair, lashes, etc.) during use. In one embodiment, the distal end of the head portion may be dimensioned to contact the eyelashes of a user along at least a major portion of the lateral width of a human eyelid. Moreover, the head portion and handle portion may be joined by a hinge or socket which permits the head portion to pivot with respect to the handle portion. The hinge and/or pivot point may be located at a position away from an axis extending longitudinally through the handle portion and towards the back side of the handle portion such that the user may apply a cosmetic composition to keratin fibers such as the eyelashes without having their hand in a direct line of sight and/or without the handle portion held between the thumb and fingers being coplanar with the head portion.

In another aspect of the invention, a kit including the applicator and a reservoir charged with a liquid cosmetic composition for application to a keratin fiber is provided. The reservoir may be configured to receive the head portion of the applicator when inserted into the reservoir so as to bring the bristles of the applicator into contact with the composition. The kit may also include a wiper attached to the reservoir for removing excess composition from the bristles upon removal of the applicator from the reservoir.

In yet another aspect of the invention, a method for applying a cosmetic composition such as mascara to the eyelashes is provided. The method may include metering a charge of a cosmetic composition (e.g., mascara) onto the bristles of the applicator and transferring the composition to the eyelashes by contacting the bristles with the eyelashes.

In another aspect of the invention, an applicator is provided. The applicator may include a handle portion having a front side opposed from a back side, and the handle portion may be suitably dimensioned to permit the applicator to be held between the thumb and fingers without accidental and/or unexpected movement of the handle portion relative to the thumb and fingers during use. The applicator may also include a head portion connected at its proximal end to the handle portion, in one embodiment via a pivotable connection, in one embodiment via a hinge. Generally, the head portion may have at its distal end a plurality of bristles for holding a charge of cosmetic composition and transferring the composition to keratin fibers (e.g., hair and/or eyelashes) during use. The head portion of the applicator may include a row of bristles disposed along the distal end of the head portion, and alternating bristles along the row may project to opposing sides of a plane through the distal end of the head portion such that adjacent bristles define an angle of from about 1 degree to about 179 degrees, in another embodiment from about 10 to about 25 degrees (e.g., about 18 degrees), in another embodiment from about 35 degrees to about 55 degrees (e.g., about 45 degrees), and in another embodiment from about 80 degrees to about 100 degrees (e.g., 90 degrees). The bristles in the row of bristles may be longer or shorter than any other bristles present on the head portion.

In yet another aspect of the invention, a kit housing an applicator for applying a cosmetic composition to eyelashes is provided. The kit may include a reservoir having flexible walls for holding a cosmetic composition and a chamber seated within or above the reservoir. The chamber may be adapted to receive an applicator therein, and may have a passage or plurality of passages therethrough such that the cosmetic composition enters the chamber when an inward force is applied to the flexible walls of the reservoir. The cosmetic composition may dwell in the chamber when the force is removed, thereby bringing the cosmetic composition in the reservoir into contact with the applicator. The kit may include a wiper having an orifice or orifices forming a passage between the exterior of the reservoir and interior of the chamber. The kit may also include a rim, ring or skirt along a rim of the reservoir for securing the chamber and/or the wiper to the reservoir. Generally, the rim, ring or skirt may be made of a material that has or is structurally designed to have a greater rigidity than the reservoir such that the kit can be gripped without deforming the reservoir or other kit portions or features situated underneath the gripping area. The rim, ring or skirt may also include a number of protrusions on one or more sides thereof to increase friction between the rim, ring or skirt and a user's fingers during removal and/or replacement of the applicator.

In certain embodiments, the kit may include an applicator for removing a portion of the cosmetic composition from the reservoir and transferring it to a surface. The applicator may be reversibly disposable through the wiper such that one or more bristles of the applicator are brought into contact with the cosmetic composition within the chamber. The kit may also include a cap configured to fit over the applicator and secure onto the rim, ring or skirt, bottle, and/or reservoir. Finally, the reservoir of the kit may contain a liquid cosmetic composition having a non-Newtonian rheology such that the composition readily flows through the passages into the chamber at a first viscosity when an inward force is applied to the walls of the reservoir and thereafter assumes a second viscosity that is higher than the first viscosity when the inward force is released such that the flow of the composition out of the chamber is retarded.

These and other aspects of the invention will become apparent to those skilled in the art after a reading of the following detailed description of the invention, including the figures and appended claims.

BRIEF DESCRIPTION OF THE FIGURES

FIG. 2 shows an exploded view of an ergonomic mascara applicator according to an embodiment of the invention.

FIGS. 3*a* and 3*b* show a perspective view and a side view of a head portion 120 comprising bristles 125 of an exemplary ergonomic mascara applicator, respectively.

DETAILED DESCRIPTION

Figure 1A:
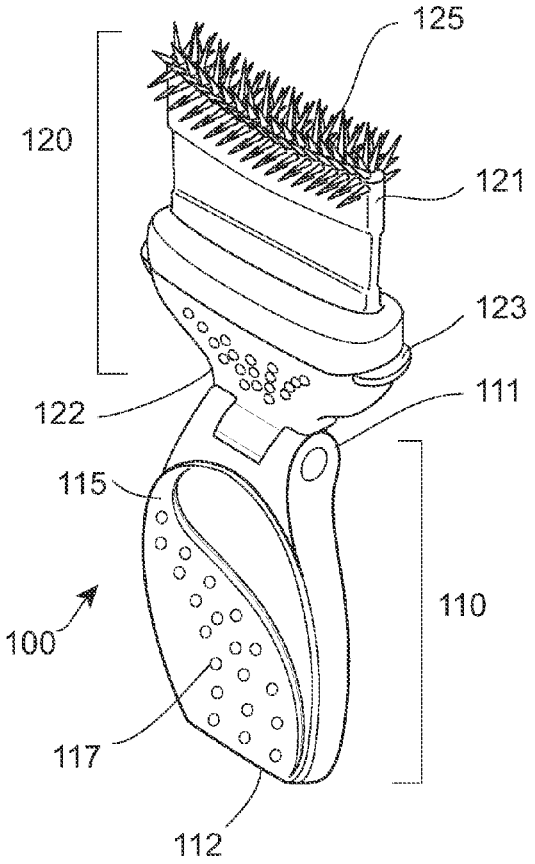
FIGS. 1*a* and 1*b* show perspective views of the front side and back side of an ergonomic mascara applicator according to an embodiment of the invention, respectively.

All terms used herein are intended to have their ordinary meaning in the art unless otherwise provided.

The materials to be dispensed are not particularly limited and include paints, cosmetics, and adhesives, inks to name a few, and may be in the form of solids (e.g., powders), suspensions, emulsions, liquids, semi-liquids and the like. As used herein, the term "liquid" is intended to include very viscous materials, including non-Newtonian liquids having very high initial viscosities, as well as gels and other materials capable of being dispensed from a container onto an applicator. The applicator according to the invention may also be useful for application of a variety of cosmetic and personal care products to keratin fibers or to the integument or skin, including without limitation, eyelash compositions, eyeliner, mascara, hair dye, hair care products, hair pigments, hair styling compositions, lipliner, lipstick, lipcolor, lip gloss, etc. As used herein, the term "keratin fibers" may include, without limitation, eyelashes, eyebrows, or hair of any part of the body, including the scalp. The viscosity of the composition is not limited and may range, for example, from about 10 cps to about 1,000,000 cps.

In one embodiment, the inventive ergonomic applicators described herein are suitable for applying a composition, such as a cosmetic composition, to eyelashes. In particular, the applicators are useful for application of an eyelash composition to the eyelashes, including without limitation, pigmented and unpigmented mascaras, pharmaceutically and/or cosmeceutically active eyelash compositions, one or more parts of a multi-component mascara formulation, or a combination thereof.

Generally, the inventive applicators comprise an ergonomic shape to improve a user's comfort and/or agility in applying the cosmetic composition. It is believed that the applicator of the present invention has an advantageous shape that allows the applicator to be more conveniently held in the hand of a user and more easily manipulated by a single hand to apply the cosmetic composition in an efficient and even manner as compared to conventional cosmetic applicators. In addition, it is believed that the applicator of the present invention is capable of providing increased coverage of eyelashes with each stroke and more uniform distribution of mascara compositions across the length of the eyelashes as compared to conventional cosmetic applicators. Without being bound by any theory, it is believed that increased coverage of eyelashes with each stroke is achieved by the advantageous size and shape which provides for increased contact area with the eyelashes. Accordingly, it is believed that the applicator can effectively deposit mascara to the eyelashes using fewer strokes than with a conventional applicator, and may also be capable of more efficiently and effectively delivering mascara to a greater surface area of the eyelashes through more uniform pressure application on and/or better bristle penetration between the eyelashes.

Figure 1B:
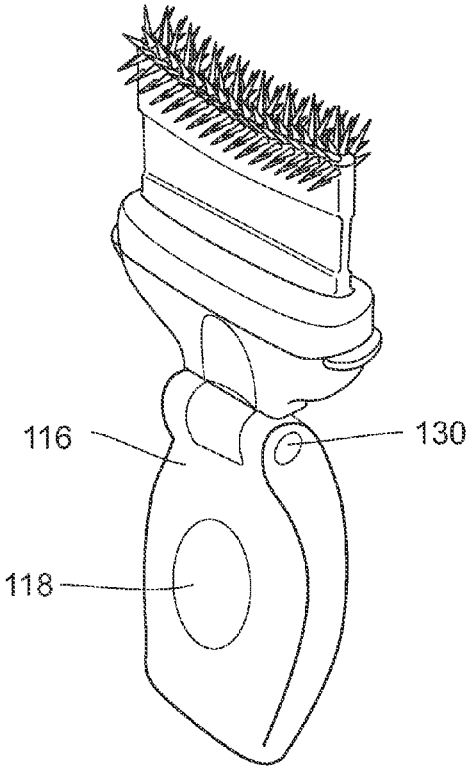

Referring to FIGS. 1*a* and 1*b*, a front perspective view and a back perspective view of an exemplary mascara applicator 100 according to the invention is illustrated, respectively. The applicator 100 is shown to include a handle portion 110 extending towards a proximal end thereof 112 and a head portion 120 extending towards a distal end thereof 121.

As shown, the handle portion 110 comprises a distal end 111 and a proximal end 112 having a first and second convex-shaped edge therebetween to define a generally non-planar structure. The handle portion 110 is shaped in such a way as to permit a user to manipulate the applicator 100 with the hand or fingers. In particular, the size and shape of the handle portion 110 permits the user to hold the same with the hand and fingers and manipulate the applicator for application of a cosmetic composition to the eyelashes.

In one embodiment, the handle portion 110 comprises a front side 115 adapted to have an index and/or middle finger of a user rested thereon and a back side 116 adapted to have a thumb of the user apply an upward and/or downward force thereto. The front 115 and back 116 sides may comprise any suitable modifications that improve the comfort and/or stability of the applicator 100 when held between fingers. For example, the front side 115 may comprise a slightly concave contour, while the back side 116 may comprise a convex contour or a combination of convex and concave curves.

In certain embodiments, the modification may include finger grip enhancements 117 that are attached to or formed integrally with the handle portion 110. The finger grip enhancements 117 may include any means for increasing the friction of the handle portion 110 against the fingers and/or thumb, such as but not limited to, raised semi-circles, ridges, depressions, other shaped projections or void spaces between such projections. Such enhancements may be present on all or a portion of the front side 117. Moreover, the finger grip enhancements 117 may be formed unitarily with the handle portion 110 or may be attached by any suitable means, including an adhesive or fusion of the enhancements with the handle portion. The finger grip enhancements 117 may be formed using any suitable technique, including molding and finishing techniques such as soft touch finish or bi-injection/overmolding of polymers.

In an illustrated embodiment, the front side 115 is shown to comprise a number of finger grip enhancements 117 in the form of projections or nibs, which may be of any size and/or shape to allow for improved grip (e.g., comfort and/or stability) of the handle portion 110. The projections 117 may comprise any material (i.e., plastic, polymer, rubber, glass, metal, etc.) and may comprise the same or similar material as the front side 115 of the handle portion 110 or may comprise a different material. Moreover, although the projections 117 are shown as being present on only a portion of the front side 115, it will be recognized that they may be present throughout for functional purposes and/or in any aesthetically pleasing design. In one embodiment the back side 116 of the handle portion 110 may also or alternatively comprise finger grip enhancements.

In another embodiment, the back side 116 of the handle portion 110 is shown to comprise a "scoop" 118 or generally elliptical indentation. The scoop 118 is ideally designed to allow for at least a portion of a user's thumb to rest therein during use of the applicator. Accordingly, the scoop 118 may assist with positioning, comfort, feel and/or control of the applicator 100.

In certain embodiments, the handle portion 110 may comprise a length of from about 20 mm to about 80 mm, from about 25 to about 35 mm, or about 30 mm. The handle portion 110 may vary in thickness along its length, such that it may have a thickness of about 7 mm towards its distal end 111 and a thickness of about 3 mm at its most proximal end 112. The handle portion 110 may also vary in width along its length, such that it may comprise a width of from about 15 mm to about 23 mm at its widest point, and a width of from about 5 mm to about 12 mm at its narrowest point. The handle portion 110 and head portion 120 may be suitably designed with a length suitable for the desired application; for example, the handle length may be longer and/or more separated from the bristles 125 so as to facilitate use in applying materials to scalp hair, eyebrows, eyelids, cheeks, etc.

Generally, the handle portion 110 may be shaped such that it allows for easier handling and better control of the applicator 110 as compared to previously known handles. For example, the curved front 115 and back 116 faces of the handle combined with the varying thickness of the handle portion throughout its length allows for a better, more comfortable grip of the handle portion between the thumb and fingers of a user. Moreover, the convex-shaped side edges can provide additional control, as a user may more easily determine where the handle portion 110 begins and ends. The handle portion 110 may be wide enough to prevent the handle from twisting or turning unexpectedly between a user's fingers (i.e., radial movements) during use and manipulation. For example, the handle may not rotate or roll about its central axis, or voluntarily tilt relative to the central axis, when held between the fingers, as an applicator having a circular or oval cross section would.

The applicator 100 also includes a head portion 120 connected to the handle portion 110 by any connecting means 130 (discussed in detail below). The head portion 120 comprises any suitable size and shape, however it will preferably comprise a size and shape that are convenient and comfortable for use with either hand, regardless of whether a user has a favored hand for applying a composition to the eyelashes. In situations where a user holds the applicator 100 only with the favored hand for application of mascara to the eyelashes on both the left and right eyes, the head portion 120 is shaped such that the applicator 100 is capable of easily accessing the full range of eyelashes for both eyes, including those eyelashes that are furthest from the favored hand or closest to the nose bridge. In one embodiment, the head portion 120 is connected to the handle portion 110 via a joint. In another embodiment, the joint is comprised of a deformable or pliable material. In another embodiment, the joint is comprised of a "stepped" joint permitting movement of the head portion 120 and the handle portion 110 relative to each other in defined intervals. In another embodiment, the joint is comprised of a stepped pin hinge.

The head portion 120 generally comprises a concave, convex, or flat distal end 121 having bristles 125 extending therefrom and a proximal end 122 including a connecting means 130. The distal end 121 and proximal end 122 are connected by a generally flat, planar, solid structure. Preferably, the head portion 120 will be substantially rigid such that it does not bend during application. However, in certain embodiments, the head portion 120 may be slightly flexible such that it may "give" during use. The head portion 120, like the handle portion 110, may comprise any number of finger grip enhancements 117 in the form of projections or nibs, which may be of any size and/or shape to allow for improved grip (e.g., comfort and/or stability) of the head portion 120, and/or to allow for a physical location cue for placement of fingers.

As shown, the head portion 120 may comprise one or more outward projections or "wings" 123 on either side thereof. The wings 123 are generally small enough as to be unobtrusive to a user during application of a cosmetic composition. However, as discussed in detail below, the wings 123 may be employed to prevent the applicator 100 from extending farther into a reservoir containing a composition than a predefined distance, and/or to hold the applicator in position during transit and daily storage. The wings 123 may also be positioned on any surface of the head portion 120. In one embodiment, the wings 123 are configured to prevent the applicator 100 from extending farther into a reservoir containing a composition than a predefined distance, and/or to hold the applicator in position during transit and daily storage. In another embodiment, the wings 123 are capable of preventing the applicator 100 from extending farther into a reservoir containing a composition than a predefined distance, and/or holding the applicator in position during transit and daily storage.

Generally, the length and curvature of the head portion 120 may be designed to as to be suitable for the desired application (for example, use for application of paints, application to an integument, application to scalp hair, etc.) In one embodiment, the length of the head portion 120 may range from about 15 mm to about 45 mm, from about 20 mm to about 35 mm, or in some embodiments may be about 25 mm. A width of the head portion 120 towards the distal end 121 thereof of may range from about 10 mm to about 50 mm, from about 12.5 mm to about 45 mm, from about 15 mm to about 40 mm, or from about 18 mm to about 23 mm (e.g., 21.5 mm). The width of the proximal end 122 of the head portion 120 may range from about 2 mm to about 45 mm, more preferably from about 4 mm to about 8 mm, and most preferably will be about 5 mm. The thickness of the head portion 120 may vary along its length, but will generally range from about 10 mm at its thickest point towards the proximal end 122 to about 1.5 mm at its thinnest point towards the distal end 121. In one embodiment, the head portion may have proximal and/or distal ends that are thicker than the section of the head portion between the proximal and distal ends.

Referring to FIG. 2, the head portion 120 may be operably connected to the handle portion 110 via a connecting means 130. In certain embodiments the connecting means 130 may be a hinge, a friction-fit mechanism, a locking mechanism, an adhesive, or the fusing during process (e.g., bi-injection or overmolding) of a distal end 111 of the handle portion 120 to the proximal end 122 of the head portion 120. In an alternative embodiment, the head portion 120 and the handle portion 110 may be integral and formed together in one piece. In some embodiments the head portion 120 may be detachably attached to the handle portion 120.

In the illustrated embodiment, the handle portion 110 is connected to the head portion 120 via a stepped pin hinge. The proximal end of the head portion 120 is shown to comprise a pin receiving member 132 which may be inserted into a complimentary cutout 133 at the distal end 111 of the handle portion 110. When the pin receiving member 132 is seated in the cutout 133, a pin 131 inserted therethrough may hold the handle portion 110 and head portion 120 into place. Such a configuration allows for tilting of the handle portion 110 to a desired angle position with respect to the head portion 120.

Accordingly, certain embodiments allow for the head portion 120 to be freely or semi-freely rotatably adjustable with respect to the handle portion 110 so as to adjust the angle between a longitudinal axis of the head portion and a longitudinal axis of the handle portion. Preferably, the head portion 120 and the handle portion 110 are fully rotatable such that an angle between a longitudinal axis of the handle portion and a longitudinal axis of the head portion ranges from about 0 to about 180 degrees. In certain embodiments, the exterior of the pin receiving member 132 may comprise any number of bumps or projections corresponding to grooves in the interior of the complementary cutout 133, such that the handle may be "stepped" through a number of predetermined angles (in one embodiment, 0°, in another embodiment, about ±35°, in another embodiment, about ±45°, in another embodiment, about ±55°, in another embodiment, about ±65°, in another embodiment, about ±75°, in another embodiment, about ±85°, and in another embodiment, about)±90°. In this way, a user may set or reversibly "lock" the handle portion 110 at a desired angle relative to the head portion 120 without fear of the relative angle between the handle and head portion changing (i.e., slipping) during use.

Generally, the applicator 100 may be suitably sized such that the hand or wrist of the user may lean on the cheek for additional support during application of a composition to the eyelashes, without the hand being in a line of sight between a user's eye and a mirror. The ability to lean on portions of the face such as the cheek or the forehead may provide increased stability and may allow the user to more precisely apply compositions (e.g., mascara) to the eyelashes and avoid a smudged appearance.

The applicator 100, including the handle portion 110 and head portion 120, may be made of any suitable material, for example, molded or blow-molded plastic, glass, metal, laminated material, or any combination thereof. Preferably, the applicator 100 may be in a relatively small and convenient size for portable use by a consumer. For example, the total length of the applicator 100 at the longest point from the proximal end 112 of the handle portion 110 to the distal end 121 of the head portion 120 (not including bristles 125) may be about the length of a standard mascara applicator (e.g., above 80 mm); may range from about 15 mm to about 80 mm, from about 25 mm to about 80 mm, from about 25 mm to about 75 mm, from about 35 mm to about 80 mm, from about 35 mm to about 65 mm, or from about 40 mm to about 60 mm. In a specific embodiment, the total length of the applicator 100 at the longest point may be approximately 55 mm, with the handle portion 110 being about 30 mm in length and the head portion 120 being about 25 mm in length.

Referring to FIGS. 3*a* and 3*b*, a perspective view and side view of the bristles 125 of a head portion 120 of an exemplary ergonomic mascara applicator are illustrated, respectively. As shown, the head portion 120 comprises a plurality of bristles 125 projecting outwardly therefrom. The head portion 120 and bristles 125 may be created individually by any suitable process, and/or may be molded integrally of any suitable material, for example a plastic material, such as a thermoplastic polyester elastomer, a thermoplastic polyurethane elastomer, or compound thermoplastic materials including SBS or SEBS. In one embodiment, the head portion 120 and bristles 125 may be injection molded.

A plurality of bristles 125 are shown for holding and releasing a composition, such as a cosmetic composition (e.g., mascara). Typically, each bristle 125 may be described as a projection and/or tine having a base that is wider than its tip. In certain embodiments, the bristles 125 may be fastened to the head portion 120 in any manner known in the art including staple set, fuse, adhesive or molding methods. The bristles 125 may comprise any suitable surface (e.g., textured or smooth) capable of holding and transferring a charge of composition. Moreover, the bristles 125 may also be capable of imparting various types of aesthetically pleasing appearances to the eyelashes, such as a volumized appearance, a separated appearance (i.e., the eyelashes being individually separated from each other), a curly appearance, etc.

The head portion 120 may be free of bristles 125 extending parallel to a longitudinal plane through the head portion. For example, the head portion 120 may include a first row of bristles extending substantially along the distal end thereof. The first row of bristles may include a first set of bristles projecting to one side of a longitudinal axis through the distal end and a second set of bristles projecting to the other side of the longitudinal axis. The first and second sets of bristles may be located along the first row in an alternating fashion such that a first angle ($\theta_1$) of from about 10 to about 25 degrees (e.g., about 18 degrees) is defined between a bristle in the first set and a bristle in the second set. Stated another way, a row of bristles disposed along the distal end of the head portion, may include alternating bristles along the row projecting to opposing sides of a plane through the distal end of the head portion such that adjacent bristles define an angle ($\theta_1$) of in one embodiment, from about 10 degrees to about 25 degrees, in another embodiment, from about 15 to about 20 degrees, and in another embodiment, about 18 degrees. In another embodiment, the first and second set of bristles are positioned such that the sets of bristles overlap so as to define the angles described above—i.e., the angle formed by the bristle as it exits from the head portion and relative to the parallel longitudinal plane through the head portion is acute. In another embodiment, the angular positioning of the bristles may differ (i.e. may be asymmetrical) from one end of the brush to the other. In another embodiment, the first and second set of bristles are positioned such that the sets of bristles do not overlap so as to define the angles described above—i.e., the angle formed by the bristle as it exits from the head portion and relative to the parallel longitudinal plane through the head portion is obtuse. In yet another embodiment, the first and second sets of bristles may be located along a first row and a second row, rather than being located along the same row.

The head portion may also include a second and third row of bristles extending substantially along the distal end of the applicator, where the second and third rows of bristles project away from the longitudinal axis so as to define a second angle ($\theta_2$) from about 35 degrees to about 55 degrees (e.g., about 45 degrees) between the second and third rows of bristles. The head portion may also include a fourth and fifth row of bristles extending substantially along the distal end of the applicator, where the fourth and fifth rows of bristles project away from the longitudinal axis so as to define a third angle ($\theta_3$) from about 80° to about 100° (e.g., 90°) between the fourth and fifth rows of bristles. Any number of additional rows of bristles 125 may be positioned orthogonal or nearly orthogonal to the longitudinal plane of the head portion. Such a configuration may allow for an appropriate amount of void space between each bristle and between each rows of bristles such that a proper amount of composition may be charged to the bristles and may subsequently be distributed on the eyelashes of a user. In one alternative embodiment, the bristles may extend substantially parallel to a longitudinal axis of the head portion 120.

In certain embodiments, one or more rows of bristles 125 may extend substantially across the width of the head portion 120. Moreover, the bristles 125 may be arranged in any suitable shape or pattern and need not be symmetrical. Examples of suitable patterns include spaced and parallel rows, staggered rows and columns, linear rows and columns, or random patterns.

Generally, the length of the bristles 125 may be designed to as to be suitable for the desired application (for example, use for application of paints, application to an integument, application to scalp hair, etc.) Bristles 125 according to one embodiment of the invention will typically be less than about 7 mm in length, less than 4 mm in length, less than 3 mm in length, and less than 2 mm in length. In one embodiment, the bristles 125 are between 2 mm and 4 mm in length. In another embodiment, the bristles 125 comprise a diameter between about 0.1 and about 1 mm, as measured at the base, and typically comprise a diameter of about 0.5 mm. The bristles 125 may be formed so that some or all of the bristles have a varying diameter, length, or cross-sectional shape. For example, some bristles may have one diameter, length, and/or shape and other bristles will have another diameter, length and/or shape. Also, the cross-sectional shape or diameter of individual bristles may change along their length. The bristles may be, without limitation, integral with the head portion or may be synthetic or natural fibers implanted therein.

In one particular embodiment, the rows of bristles spaced at a first angle ($\theta_1$) from a longitudinal axis of the head portion 120 may be longer than other rows of bristles spaced at other angles (i.e., bristles at a second angle ($\theta_2$) or third angle ($\theta_3$)).

Although described herein as "bristles," it will be appreciated that such bristles 125 may be made of any material and configuration capable of holding a charge of liquid or solid material and transferring it to the desired surface, such as a human integument, including keratin fibers (hair of the scalp, eyelashes, etc.), nails, lips, skin, or the like. The bristles may, for instance, take the form of a foam pad, a molded brush, a twisted wire brush, a flocked surface, a staked fiber brush, a comb, a plastic spatula, a sponge, or any other surface which can hold and deliver the liquid or solid material. In one embodiment, the bristles 125 may be in the form of a foam pad. In other embodiments, the bristles 125 may be made of rubber, sponge, or any other flexible or rigid material.

Figure 4B:
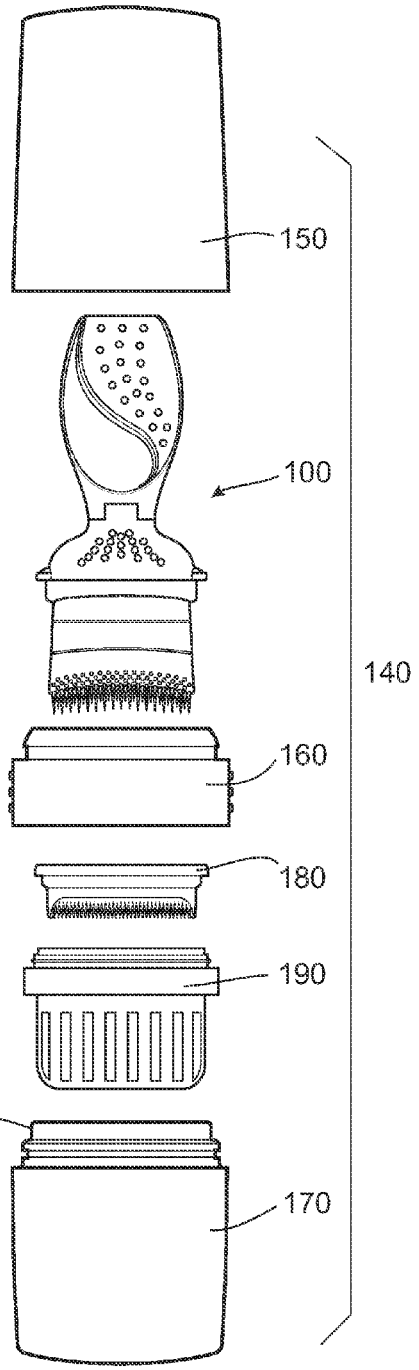
FIGS. 4*a* and 4*b* show an exemplary kit 140 including an ergonomic applicator in a closed perspective view and an exploded view, respectively.
Figure 4A:
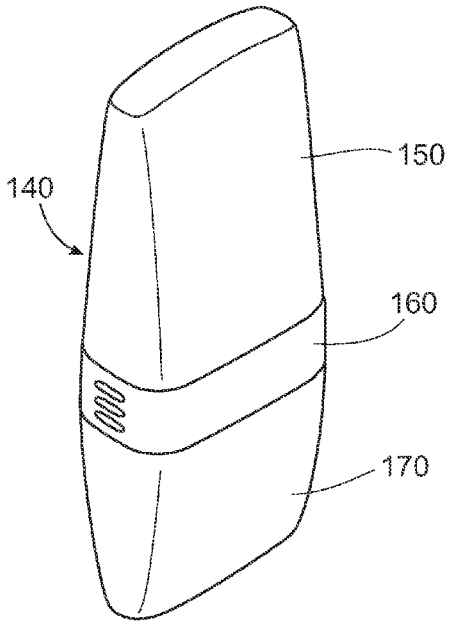

Referring to FIGS. 4*a* and 4*b*, an exemplary kit 140 including an ergonomic applicator in a closed view and exploded view are illustrated, respectively. A kit 140 may comprise a reservoir 170 containing or charged with a cosmetic composition, preferably a liquid cosmetic composition such as a mascara, and the applicator 100 may be seated therein. As shown, an exemplary kit comprises a cap 150, a rim, ring or skirt 160, a reservoir 170, a wiper 180, a chamber 190, and an applicator 100.

In FIG. 4*a*, the kit 140 is shown in a closed state, wherein a cap 150 can be sealably engaged with a reservoir 170 via a rim, ring or skirt 160. The reservoir 170 generally comprises side walls extending from a closed base to an open mouth to define an interior space for holding a charge of a composition, such as a cosmetic liquid composition (e.g., mascara). The reservoir 170 is typically made of any suitable flexible material, for example, molded or blow-molded plastic, laminated material, foil, or any combination thereof, such that the reservoir may be squeezed/rolled-up by a user to charge the bristles of an applicator seated therein with a composition. It will be appreciated that the size and/or shape of the reservoir may depend on a number of variables, such as but not limited to the intended use, the size/shape of an applicator, and/or the composition contained therein.

In one embodiment the reservoir 170 may be suitably dimensioned so as to hold a commercially sold volume of material (for example, be dimensioned so as to hold shampoos, personal care products, etc., in travel, regular, and/or economy sizes). In one embodiment, the reservoir comprises a height of from about 20 to about 50 mm, more preferably from about 25 to about 45 mm, and most preferably from about 30 mm to about 40 mm (e.g., 38 mm). The reservoir 170 may comprise a length along a longer side of from about 20 mm to about 40 mm, and more particularly from about 25 to about 35 mm; and a length along a shorter side of from about 10 mm to about 30 mm, more particularly from about 15 mm to about 20 mm. The reservoir 170 may comprise an opening having a width or diameter of from about 20 to about 30 mm in one direction and from about 10 to about 15 mm in an opposite direction.

As shown in FIG. 4*b*, a cap 150 may comprise any complementary size and shape to the reservoir 170 and a rim, ring, or skirt 160 that is capable of fitting around and securing a handle portion of the applicator 100 therewithin. Typically, the cap 150 is also made from a flexible material, such as a plastic, although in some embodiments the cap may comprise a rigid material in one or more dimensions or a combination of flexible, rigid and gasket/rubber like material.

The cap 150 will generally comprise a snap fit or other closing means such that it may be temporarily affixed or affixed and compressed to a complementary closing means of a rim, ring, reservoir, or skirt 160. In this way, the cap 150 may be reversibly attached to the reservoir 170 (directly or via the rim, ring or skirt 160) to prevent the applicator 100 from inadvertently being disengaged or removed therefrom. When a user desires to remove the applicator 100, the cap 150 is removed from the reservoir 170 (i.e., pulled off) and the applicator is pulled from within the reservoir and/or chamber. It will be appreciated but is not essential that the cap 150, rim, ring or skirt 160, and reservoir 170 may each comprise a complementary size and shape such that, when connected together, the individual pieces form a continuous outer surface of a container.

In one embodiment the cap 150 may comprise a length of from about 30 to about 80 mm, more preferably from about 40 to about 50 mm, and most preferably from about 42 mm to about 46 mm (e.g., 44 mm). The cap 150 may comprise an opening having a width or diameter of from about 20 mm to about 50 mm, more preferably from about 30 to about 40 mm, and most preferably from about 32 to about 36 mm (e.g., 33 mm). Of course, the dimensions of the cap will depend on at least the size and/or shape of the applicator 100, rim, ring or skirt 160 and reservoir 170.

In one embodiment, the cap 150 and handle portion of an applicator may be integrally formed, such that the handle portion is removed from the reservoir 170 when the cap is removed. In another embodiment a cap 150 may comprise a handle portion removably formed therein.

Figure 5A:
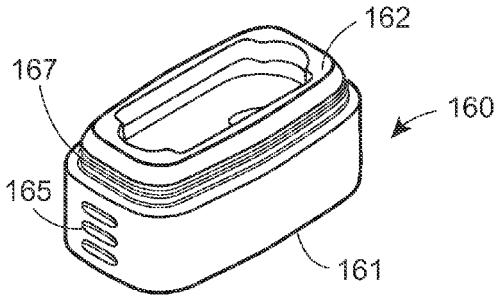
FIGS. 5*a* and 5*b* show top perspective and side cross-sectional views of an exemplary rim, ring or skirt 160 according to an embodiment of the invention, respectively.
Figure 5B:
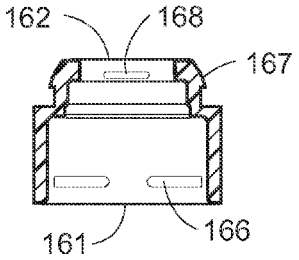

Referring to FIGS. 5*a* and 5*b*, a top perspective and cross-sectional view of an exemplary rim, ring or skirt 160 according to an embodiment of the invention are illustrated, respectively. As shown, the rim, ring or skirt 160 comprises an open bottom portion 161 having side walls extending therefrom to an open top portion 162. The rim, ring or skirt 160 is generally adapted to sit between a cap 150 and a reservoir 170 of an exemplary kit 140. As such, the bottom portion 161 of the rim, ring or skirt may comprise any shape that is compatible with the top portion of the reservoir 170, and the top portion 162 of the rim, ring or skirt may comprise any shape that is compatible with the bottom portion of the cap 150.

In one embodiment, the inner surface of the bottom portion 161 of the rim, ring or skirt 160 may comprise an inner fastening means 166 (e.g., snap fit, threading, etc.) adapted to permanently fasten, join, or snap the rim, ring or skirt to a corresponding fastening means located on the outer surface of the top portion of the reservoir (FIG. 4*b* at 170). The outer surface of the top portion 162 of the rim, ring or skirt 160 may comprise an outer fastening means 167 (e.g., snap fit, threading, etc.) adapted to removably fasten, join, or snap, the rim, ring or skirt 160 to corresponding fastening means located on an inner surface of a bottom portion of a cap (FIG. 4*b* at 150). Accordingly, when a user holds the rim, ring or skirt 160 and attempts to remove the cap 150 from the kit, the rim, ring or skirt will remain attached to the reservoir 170, while the cap is detached. As discussed in detail below, the rim, ring or skirt may also include an inner stopping means 168 to engage the wings 123 of an applicator such that the applicator is prevented from being pushed downward into a reservoir or disengaged during transit or storage.

Generally, the outer surface of the rim, ring or skirt 160 may include finger grip enhancements 165 (e.g., bumps, protrusions, grooves and/or cut-outs) on one or more sides thereof to increase friction between the outer surface of the kit and the thumb and/or fingers of a user. Whereas the reservoir 170 and cap 150 of an exemplary kit may be made of a flexible material, in one embodiment the rim, ring or skirt 160 comprise a relatively rigid material, such as but not limited to injection molded or blow-molded plastic, glass, metal, laminated material, or any combination thereof. In this way, the rim, ring or skirt 160 may be gripped by a user to remove the cap 150, without squeezing the reservoir 170.

Figure 6A:
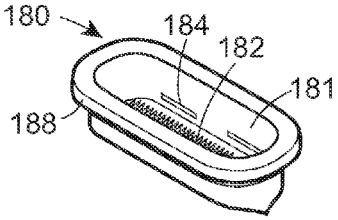
FIGS. 6*a*-6*c* show top perspective, bottom perspective and side cross-sectional views of an exemplary wiper 180 according to an embodiment of the invention, respectively.
Figure 6B:
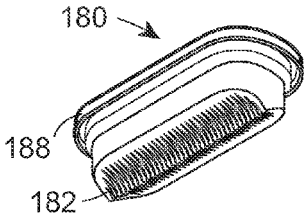
Figure 6C:
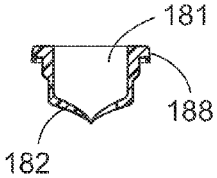

Referring to FIGS. 6*a* through 6*c*, a top perspective, bottom perspective and a cross-sectional view of an exemplary wiper 180 according to an embodiment of the invention are illustrated, respectively. Generally, a wiper 180 is adapted to be seated within a reservoir 170. The wiper 180 may comprise an orifice 181 in a top portion thereof, and one or more projections 182 (e.g., edges, teeth, or the like) that engage with bristles of an applicator when they extend into the interior of the reservoir. When the applicator is removed from the reservoir, such as by pulling or the like, the bristles may pass through the projections 182 of the wiper 180, and any excess composition contained thereon may be freed and maintained inside the reservoir.

The dimension and geometry of the wiper 180 may vary depending on several factors, such as but not limited to, the thixotropy, pseudoelasticity, or other viscosity of the composition and/or the shape and size of the bristles. As shown, one embodiment of the wiper 180 comprises a number of projections 182 extending from either side of the bottom side of the wiper to form a curved V-shape having broad, wide cuts. The projections 182 extend downward from the bottom of the wiper 180 towards an plane through the middle of the wiper orifice.

In certain embodiments, a composition contained in a reservoir may be prevented from escaping when an applicator is positioned within the orifice 181 of the wiper 180. The wiper orifice 181 and applicator 100 may form a seal, preferably a liquid-tight seal, and more preferably an air-tight and vapor seal, when the applicator is seated within the orifice. Accordingly, the orifice 181 may comprise a size/shape that is complementary to the size/shape of an exemplary applicator head portion. For example, the dimensions and size of the orifice 181 may vary depending on the geometry of the head portion and bristle configuration of the applicator. Thus, the orifice 181 may be rectangular when the cross-sections of the head portion of an applicator is rectangular.

In certain embodiments, the curved V-shape of the projections 182 may prevent the applicator from inadvertently exiting the reservoir, such as when the projections apply a force on either side of the bristles or head portion of the applicator. Additionally or alternatively, the wiper 180 may or may not comprise a snap fit, friction fit or other inner connecting means 184 to removably anchor an applicator within the orifice 181 thereof. As shown, the wiper 180 may comprise an outer wiper rim 188 extending from the top portion of the wiper away from the orifice 181 and slightly downward toward the bottom thereof. Such a structure may allow the wiper to be held within a chamber 190 of the kit, as discussed in detail below.

Figure 7A:
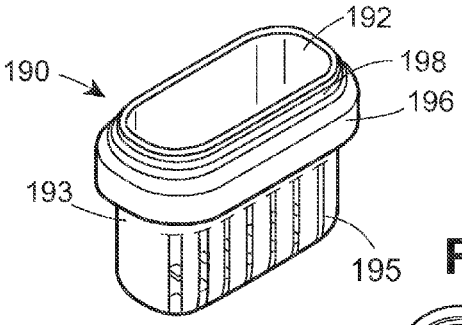
FIGS. 7*a*-7*c* show top perspective, side cross-sectional, and bottom views of an exemplary chamber 190 according to an embodiment of the invention, respectively.
Figure 7B:
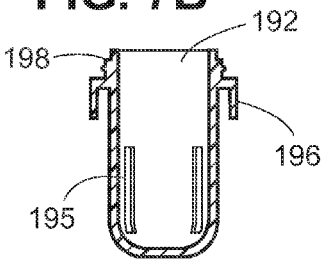
Figure 7C:
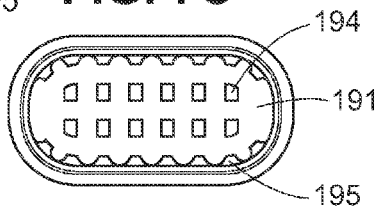

Referring to FIGS. 7*a* through 7*c*, a top perspective view, side cross-sectional view, and bottom view of an exemplary chamber 190 according to an embodiment of the invention are illustrated, respectively. As shown, the chamber 190 comprises a bottom surface 191 connected to an open top portion 192 by side walls 193. In one embodiment, the chamber 190 lacks a bottom surface 191, but may comprise a constriction at the bottom of the chamber to limit or regulate flow into and/or out of the chamber. Generally, the chamber 190 may be adapted to sit within a reservoir 170 and may therefore comprise any size/shape that is compatible with a reservoir. As shown, an exemplary chamber 190 comprises a bottom surface 191 having a generally rectangular shape with rounded corners.

The bottom surface 191 comprises any number and shape of passages or pores 194 that allow the passage of a cosmetic composition therethrough when inward pressure (e.g., squeezing) is applied to the reservoir or during insertion of the chamber into the reservoir. The pores 194 may allow for substantially one-way passage of the composition into the chamber 190, such that composition may not exit or may partially exit the chamber once it enters (or only small amounts may exit). In this way the chamber 190 forms a chamber filled with the composition upon squeezing of the outer walls of a reservoir by a user or insertion of the chamber into the reservoir. In another embodiment, the chamber 190 lacks a bottom surface 191. but is configured so as to allow for substantially one-way passage of the composition into the chamber 190, such that composition may not exit or may partially exit the chamber once it enters (or only small amounts may exit). In another embodiment, the chamber 190 has a bottom surface 191. with a single opening but is configured so as to allow for substantially one-way passage of the composition into the chamber 190, such that composition may not exit or may partially exit the chamber once it enters (or only small amounts may exit).

The pores 194 may comprise any suitable shape and size. For example, the shape of the pores 194 may be, without limitation, a circle, semi-circle, square, rectangle, triangle, etc. In one specific embodiment, the pores may comprise a rectangular shape of about 1.4 mm by 1.8 mm. More generally, the pores may comprise a surface area of from about 1 $mm^2$ to about 5 $mm^2$. If pores are present in the bottom surface, any number of pores 194 may be spaced throughout the bottom surface, for example from about 1 to about 20 pores, from about 5 to about 15 pores, or from about 10 to about 12 pores may be present in the bottom surface. Such pores 194 may be spaced throughout the bottom portion 191, for example at a distance of from about 1 mm to about 4 mm and preferably about 2 mm.

The side walls 193 along the longer sides of the chamber 190 are shown to comprise a number of additional pores or apertures 195 (e.g., elongated slits) spaced throughout the length of the side walls. It will be appreciated that the apertures 195 may allow for the passage of a composition therethrough when inward pressure (e.g., squeezing) is applied to a reservoir or during insertion of chamber in bottle. The apertures 195 may allow for substantially one-way passage of the composition into the chamber 190, such that composition may not exit the chamber once it enters (or only limited amounts of composition may exit).

The apertures 195 may comprise any suitable shape and size, such as but not limited to a rectangle, circle, semi-circle, square, triangle, etc. In one embodiment, the aperture may comprise a rectangular shaped slit of about 1.2 mm by about 9 mm. More generally, an exemplary slit may comprise a surface area of from about 5 $mm^2$ to about 12 $mm^2$ (e.g., about 10 $mm^2$. If apertures are present in the side walls, any number of apertures 195 may be spaced throughout the side walls 193, for example from about 1 to about 40 apertures, from about 10 to about 30 apertures, from about 15 apertures to about 25 apertures, or from about 18 to about 20 apertures may be present in the side walls. Such apertures 195 may be spaced throughout the length of the side walls 193, for example at a distance of from about 1 to about 3 mm apart (e.g. about 2 mm apart). In one embodiment, the chamber 190 may not comprise any apertures 195 on shorter side walls thereof. In other embodiments, the chamber may comprise apertures along all or substantially all side walls 193.

In one specific embodiment, the chamber 190 may comprise a length along its longer sides of from about 20 mm to about 30 mm, more preferably from about 22 mm to about 28 mm, and most preferably from about 24 mm to about 26 mm. An exemplary chamber 190 may comprise a length along its shorter sides of from about 5 mm to about 15 mm, more preferably from about 8 to about 13 mm, and most preferably from about 9 to about 12 mm. As discussed above, in one embodiment the chamber 190 will have a size and/or shape dependent upon that of a reservoir 170 and/or applicator 100 of a kit.

The inventive design of the chamber 190 with passageways (i.e., pores 194 and apertures 195, open bottom design, and/or bottom designed with a single opening such as one or more constrictions (in one embodiment ovoid, in another embodiment taking the form of physical baffles) at the lower end of the chamber for regulating fluid flow into and/or out of the chamber) allows for substantially one-way passage of composition from a reservoir 170 into the chamber. Accordingly, a user may squeeze the outside walls of a reservoir in order to fill the chamber 190 with composition, and such composition, once held within the chamber, may not exit the chamber (or may only exit in small quantities) through the openings, pores or apertures. The bristles of an applicator 100 may then be charged with composition merely by placing the bristles within the chamber, rather than having to push the applicator deep into the reservoir. This feature is advantageous as it allows for shorter applicators to be employed and may prevent an applicator stored within a composition-filled chamber from excessive bristle drying. In one embodiment, the inventive design of the kit allows the user to charge an applicator with mascara by bringing the mascara into contact with the brush, for example by squeezing the flexible container rather than bringing the brush into contact with the mascara, for example by inserting the brush into a reservoir of mascara.

It will be appreciated that the design of the chamber 190 is not limited to any particular configuration, provided that it (1) is suitable to permit passage of a cosmetic composition from the reservoir into a location within the chamber in contact with bristles of an applicator; and (2) retards the flow of the cosmetic composition from within the chamber back to the reservoir.

In one embodiment, a liquid cosmetic composition having a non-Newtonian rheology may fill the reservoir such that the composition readily flows through the passages (i.e., pores and/or apertures) into the chamber 190 at a first viscosity when an inward force is applied to the walls of the reservoir. The liquid may then assume a second viscosity that is higher than the first viscosity when the inward force is released such that the flow of the composition out of the chamber is retarded. Accordingly, the chamber 190 may be adapted to impart a second viscosity on a liquid cosmetic product that is higher than the viscosity of the liquid when contained in a reservoir. In addition, the apertures may be suitably designed with respect to geometry so as to allow substantially only one-way passage of the liquid cosmetic product.

In one embodiment, the chamber 190 comprises an outer lip 196 such that it may be attached to a reservoir 170 at a specific depth and without falling through to the bottom of a reservoir. For example, a chamber 190 may be inserted into a reservoir 170 during manufacture until the lip 196 of the chamber catches on an outer rim 176 of the reservoir (discussed in detail below).

Figure 8:
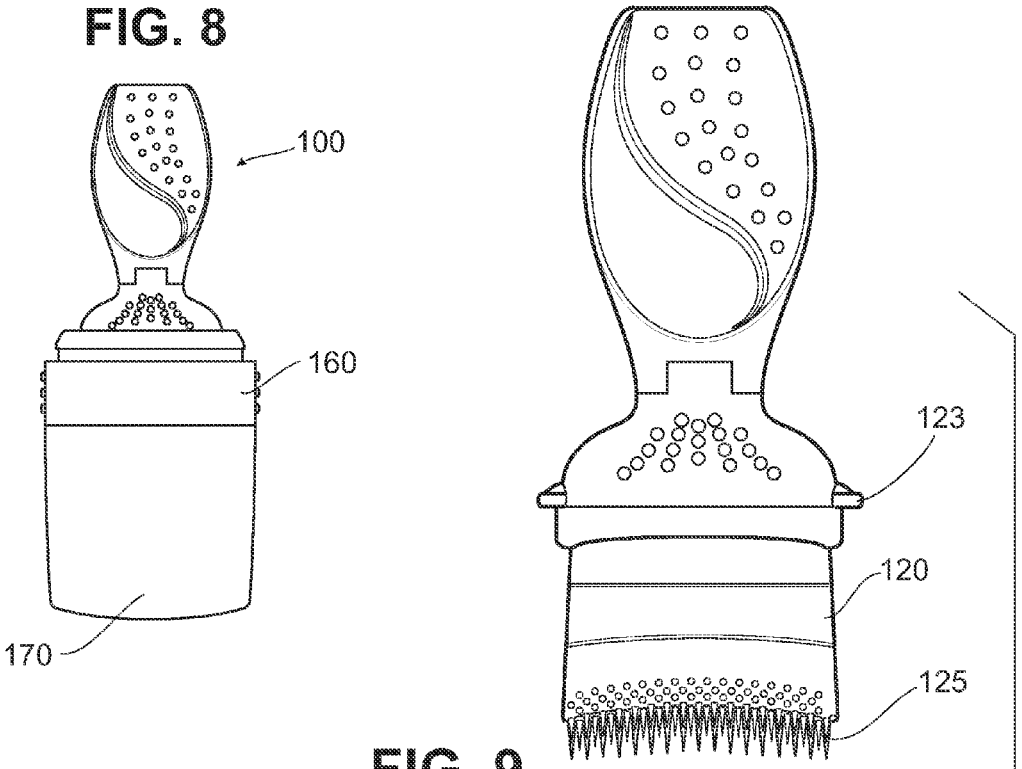
FIG. 8 shows an exemplary ergonomic applicator seated within a reservoir, wiper, chamber and rim, ring or skirt to close the reservoir.

Referring to FIG. 8, the applicator 100 may serve as a closure element for the reservoir 170 and/or reservoir 170 sub-assembly, without the use of a separate closure device, such as a cap or a cover. Generally, the composition contained in a reservoir 170 may be prevented from escaping when an applicator is positioned within the wiper and reservoir. The wiper orifice and applicator 100 may form a seal, preferably a liquid-tight seal, and more preferably a vapor and/or air-tight seal, when the applicator is seated within the orifice.

Moreover, the head portion of an applicator may comprise one or more wings 123 on either side thereof which may take the form of outward projections extending laterally from the head portion. The outward projections or wings 123 may prevent the applicator from being depressed into the reservoir beyond a predefined point. Accordingly, the outward projections or wings may "catch" or otherwise be prevented from moving in a downward direction by a stopping means located on the interior or exterior of a wiper, chamber, or rim, ring or skirt. For example, the rim, ring or skirt 160 may comprise an inner stopping means (see FIG. 5*b* at 168), which may allow for the head portion of the applicator to be inserted therethrough, but which may prevent the wings 123 of the head portion from progressing downward or upwards upon application of force.

Figure 9:
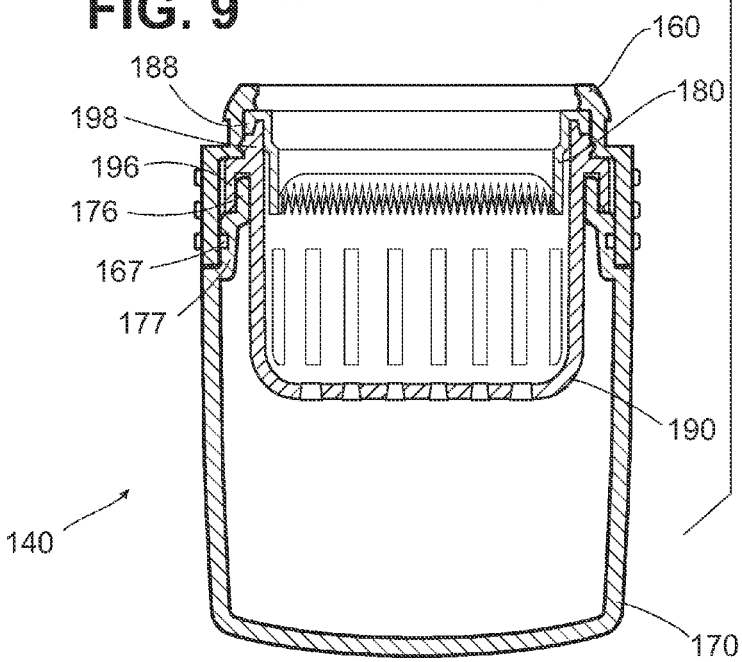
FIG. 9 shows a cross sectional view of an exemplary kit 140 according to an embodiment of the invention. The kit is shown to comprise a reservoir 170, a chamber 190, a wiper 180, and a rim, ring or skirt 160.

Referring to FIG. 9, a cross-sectional view of an exemplary kit 140 is shown having a wiper 180 seated within a chamber 190, which in turn is seated within the reservoir 170. As discussed above, when closed, the kit 140 comprises an applicator 100 seated within the wiper 180 such that the head portion 120 of the applicator is in contact with a composition contained within the reservoir 170.

As shown, the reservoir 170 comprises a closed bottom portion having flexible side walls extending therefrom to an open top portion. The outer surface of the open top portion of the reservoir is adapted to receive the inner surface of the rim, ring or skirt 160. For example, the outer surface of the top portion of the reservoir 170 may comprise a snap-fit (i.e., groove, rim, lip or projection) 177 that is complementary to the inner fastening means 167 of the rim, ring or skirt 160. In this way the rim, ring or skirt 160 may be permanently attached to the reservoir 170. In alternative embodiments, the rim, ring or skirt 160 may be removably attached to the reservoir or may be attached via complementary threading or the like.

An outer rim 176 located at the top portion of a reservoir 170 may be adapted to receive an outer lip 196 of the chamber 190, such that the lip of the chamber catches on the top portion, preventing the chamber from falling into the reservoir when inserted therein. Generally, the chamber 190 may be fastened, snapped or joined to the top portion of the reservoir 170 by any suitable means.

The chamber 190 may comprise an upper rim 198 about its open top portion such that an outer wiper rim 188 of the wiper 180 may catch on the upper rim 198 when the wiper is inserted into the chamber. The upper rim 198 therefore prevents the wiper 180 from falling into the chamber 190 when a downward force is exerted thereon (i.e., when an applicator is pushed into the reservoir and when an applicator is utilized to create a seal). Generally, the wiper 180 may be fastened, snapped or joined to the top portion of the chamber 190 by any suitable means.

In one particular embodiment, the chamber 190 and wiper 180 may be prevented from being pulled off of the reservoir (e.g., during withdrawal of the applicator) by attaching the rim, ring or skirt 160 onto the reservoir 170, over the chamber and wiper. The top portions of the chamber 190 and wiper 180 may both be shaped in such a way that an inner surface of the rim, ring or skirt 160 rests on at least a portion thereof. Accordingly, the chamber 190 will be prevented from being pulled out of the reservoir 170 by the rim, ring or skirt 160, which is fastened to (i.e., prevented from being pulled away from) the reservoir.

The reservoir 170, chamber 190 and wiper 180 are configured to receive the head portion 120 of an applicator 100 so as to bring the bristles 125 of the applicator into contact with a composition housed within the reservoir. Once the applicator head portion 120 is seated within the reservoir 170 (via the wiper and chamber), any composition contained within the reservoir is prevented from exiting through the orifice of the wiper. Accordingly, the inventive kits may prevent or reduce bacterial contamination and lost volume of composition due to squeezing, spillage, backsplash, and/or diffusion.

Figure 10A:
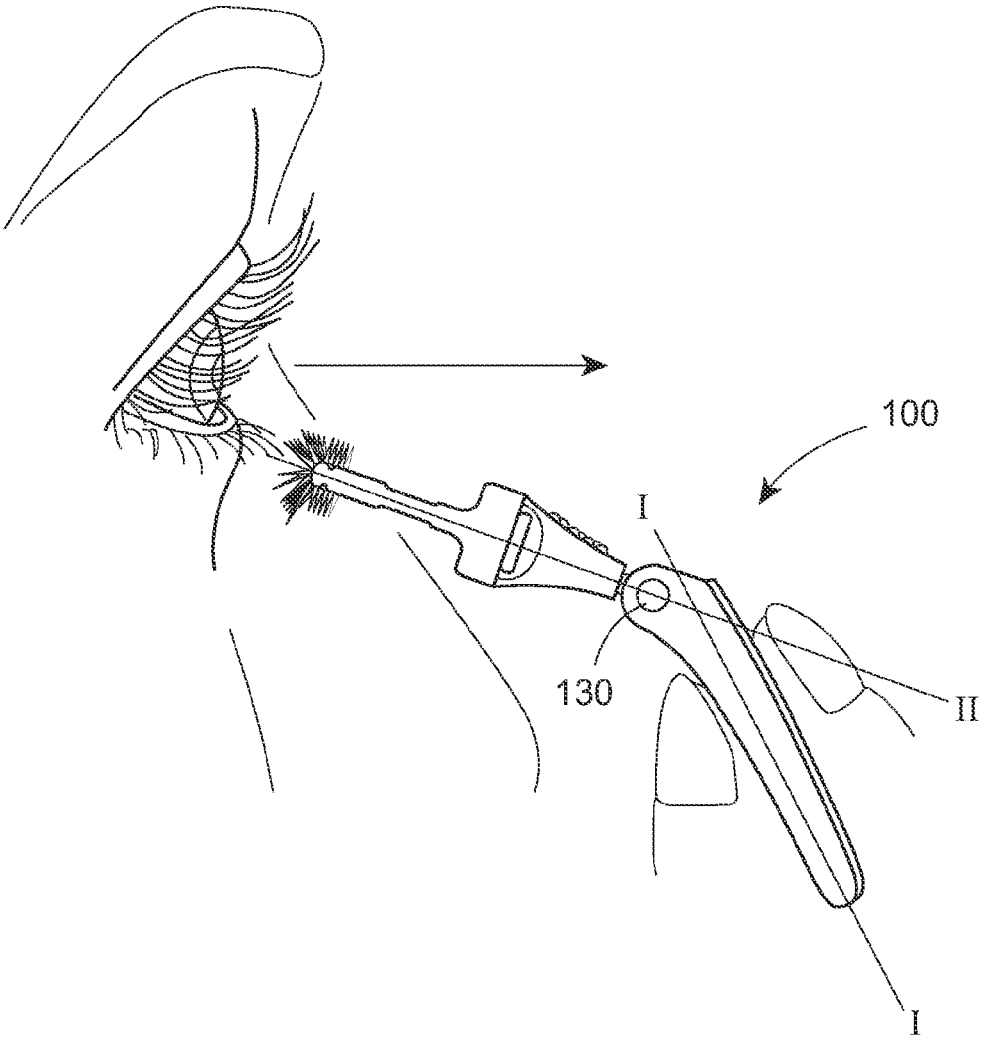
FIGS. 10*a*-*b* are process diagrams for the application of a cosmetic composition to the eyelashes of a user, using an exemplary ergonomic mascara applicator 100 according to an embodiment of the invention.
Figure 10B:
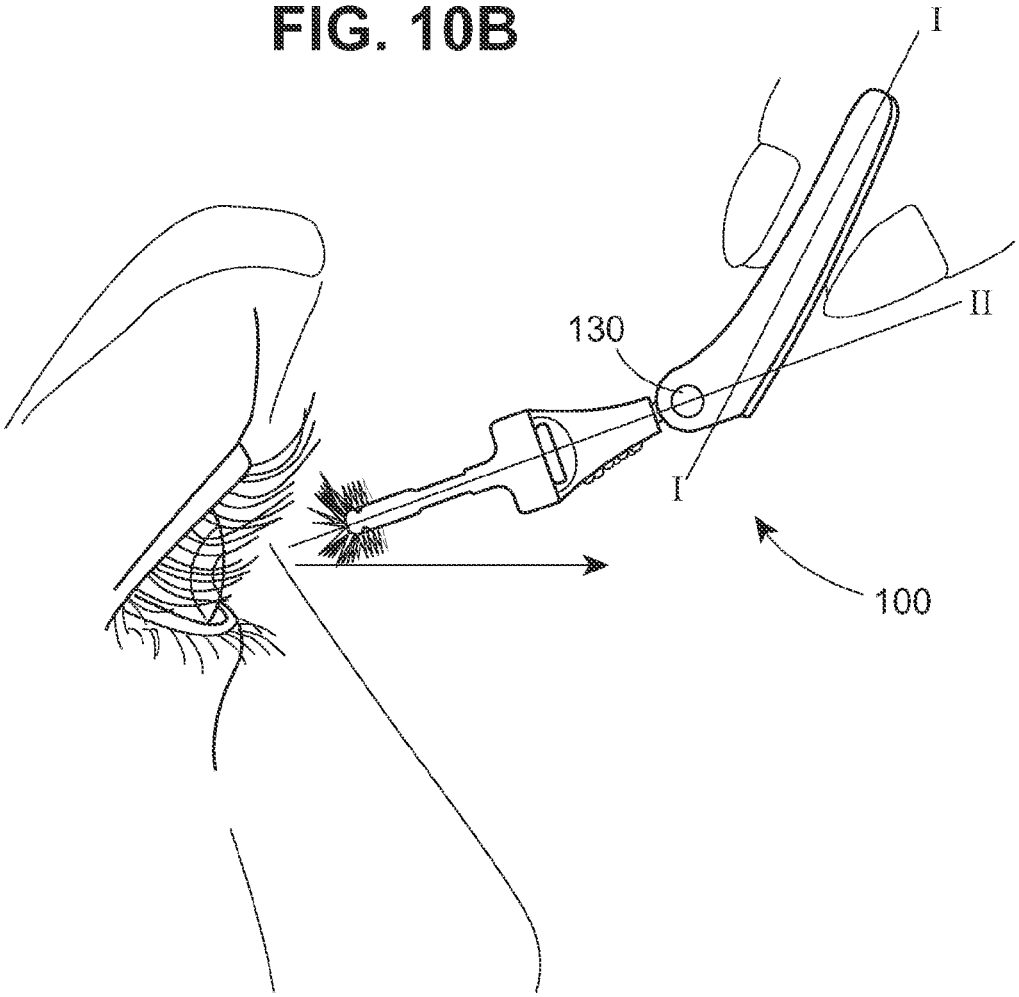

Referring to FIG. 10, a process diagram for the application of a cosmetic composition using an exemplary applicator 100 is illustrated. Once the bristles of the applicator 100 are impregnated with composition, such as when a user squeezes a reservoir in which the applicator is seated, the applicator may be removed and used to apply the composition to a desired structure or surface. In one embodiment, the applicator 100 is removed from the reservoir, and a wiper acts to remove excess product from the bristles.

In the case of mascara, a charged applicator 100 may be used to apply the mascara to a user's eyelashes. As shown, a user may hold the handle portion of the applicator 100 between the thumb and fingers and place the head portion directly in front of the eyelashes in a substantially horizontal position, where the head portion would be orthogonal or substantially orthogonal to the eyelid. The applicator 100 is then easily moved upwardly (towards the top of the head) or downwardly (toward the chin) in a single motion such that the bristles engage the eyelashes and deposit a mascara composition in a uniform manner thereon.

In one embodiment, the ability to rotate the head portion 120 with respect to the handle portion, combined with the "scooped" design of the back side of the handle portion and/or the location of the connecting means 130 along the handle allow the user to utilize the applicator without having their hand in their direct line of sight. As shown, the connecting means 130 may be located along an axis II-II extending from a proximal end of the head portion of an applicator through the handle. When a user holds the applicator along the handle, an axis I-I extending substantially longitudinally through the distal end of the handle portion and centered approximately between the fingers may be defined. As shown, the connecting means 130 is located at a point on the handle below the axis I-I (i.e., towards the back side of the handle portion). Such a configuration allows for the user to view the eyelashes in a mirror or the like while using the applicator to apply a cosmetic thereto.

The invention having been described by the forgoing description of various embodiments, it will be understood that the skilled artisan may make modifications and variations of these embodiments without departing from the spirit or scope of the invention as set forth in the following claims.

What is claimed:

1. An applicator comprising:

a handle portion having a front side opposed from a back side, the handle portion being suitably dimensioned to permit the handle portion to be held between the thumb and fingers during use; and a head portion comprising a generally flat portion and having at its distal end a plurality of bristles for holding a charge of a cosmetic composition and transferring the composition to eyelashes during use, said head portion having a width between 12.5 and 50 mm at the distal end and a thickness between 1.5 and 10 mm at the thickest part of the head portion, wherein at least one row of bristles extends substantially across the width of the head portion, wherein the distal end of the head portion is suitably dimensioned to contact the eyelashes along at least a major portion of the lateral width of a human eyelid;

wherein the handle portion and the head portion are joined in a manner which permits the head portion to pivot with respect to the handle portion, the joint being located at a position away from an axis extending longitudinally through the handle portion and towards the back side of the handle portion such that the user may apply the cosmetic composition to the eyelashes without having their hand in a direct line of sight.

2. The applicator according to claim 1, wherein the handle portion and the head portion are joined by a hinge.

3. The applicator according to claim 1, wherein the handle portion is non-coplanar with the head portion.

4. The applicator according to claim 1, wherein the distal end of the head portion has a configuration to approximate the curvature of the eye lids.

5. The applicator according to claim 1, wherein the back side of the handle portion has a concave shape.

6. The applicator according to claim 1, wherein the bristles do not extend in a direction parallel to a longitudinal plane coplanar with the head portion.

7. A kit comprising:

the applicator according to claim 1;

a reservoir charged with a composition for application to a keratin fiber, wherein the reservoir is configured to receive the head portion of the applicator when the head portion of the applicator is inserted into the reservoir so as to bring the bristles into contact with the composition; and a wiper attached to the reservoir for removing excess composition from the bristles upon removal of the applicator from the reservoir.

8. A method for applying mascara to the eyelashes comprising metering a charge of mascara onto the bristles of the applicator according to claim 1 and transferring the composition to the eyelashes by contacting the bristles with the eyelashes.

9. The applicator of claim 1, wherein the head portion is free of bristles extending parallel to a longitudinal plane coplanar with the head portion.

10. The applicator according to claim 1, wherein the first row of bristles comprises bristles having a length greater than a length of any remaining bristles.

* * * * *